United States Patent [19]

Clarke

[11] Patent Number: 5,063,842

[45] Date of Patent: Nov. 12, 1991

[54] SCREEN TENSIONING AND FRAMING DEVICE AND METHOD THEREFOR

[75] Inventor: Joseph Clarke, Naperville, Ill.

[73] Assignee: M & R Printing Equipment, Inc., Glen Ellyn, Ill.

[21] Appl. No.: 591,711

[22] Filed: Oct. 2, 1990

[51] Int. Cl.[5] ..... B05C 17/08; B41F 23/04

[52] U.S. Cl. ..... 101/127.1; 101/128; 101/128.1; 101/114; 101/487; 24/587; 38/102.4

[58] Field of Search ..... 101/127.1, 128, 128.1, 101/114, 123, 480, 487, 415.1; 24/587

[56] References Cited

U.S. PATENT DOCUMENTS

| | | | |
|---|---|---|---|
| 2,608,750 | 9/1952 | Cluzel | 38/102.4 X |
| 2,759,217 | 8/1956 | Peterson | 38/102.4 |
| 3,176,843 | 4/1965 | Hoskins et al. | 101/127.1 X |
| 3,391,635 | 7/1968 | Matheus | 101/127.1 |
| 3,800,697 | 4/1974 | Sullivan | 101/127.1 X |
| 3,908,293 | 9/1975 | Newman | 101/127.1 X |
| 3,962,805 | 6/1976 | Hamu | 101/127.1 X |
| 3,991,677 | 11/1976 | Barnes | 101/127.1 |
| 4,254,707 | 3/1981 | Lambert et al. | 101/127.1 X |
| 4,373,441 | 2/1983 | Messerschmidt | 101/127.1 |
| 4,462,174 | 7/1984 | Messerschmidt | 101/127.1 X |
| 4,978,414 | 12/1990 | Ohtani et al. | 156/494 |

FOREIGN PATENT DOCUMENTS

| | | | |
|---|---|---|---|
| 778380 | 7/1967 | United Kingdom | 101/127.1 |

OTHER PUBLICATIONS

Cincinnati Printing & Drying Systems, Inc. 1971 Screen Stretching Clamps Brochure, "Screen Sensioning", *Screen Printing,* pp. 48 et seq., Feb. 1984.

*Primary Examiner*—Edgar S. Burr
*Assistant Examiner*—Eric P. Raciti
*Attorney, Agent, or Firm*—Wallenstein, Wagner & Hattis, Ltd.

[57] ABSTRACT

A screen tensioning and framing device comprising two opposing pairs of bars, the opposing bars being generally parallel to each other, means for attaching an edge portion of the screen to each of the bars, and means for pulling each of the bars to create tension in the screen.

28 Claims, 3 Drawing Sheets

FIG. 2
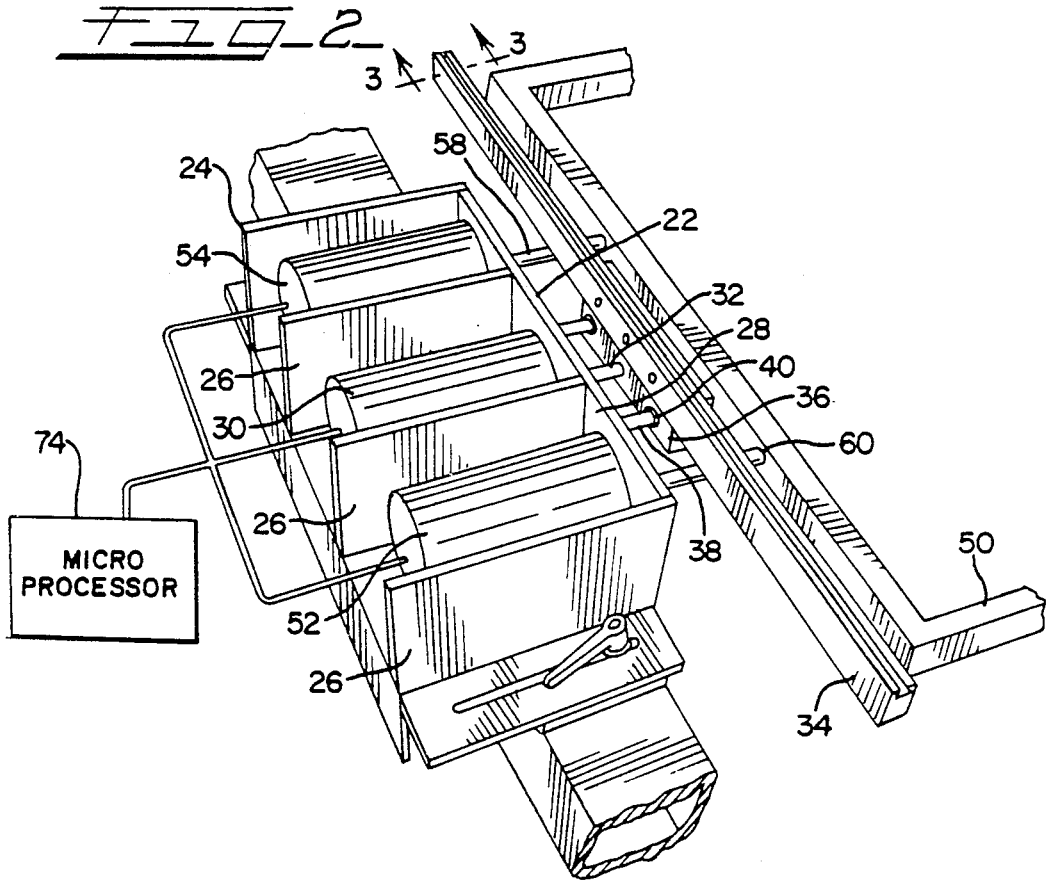
FIG. 3
FIG. 4
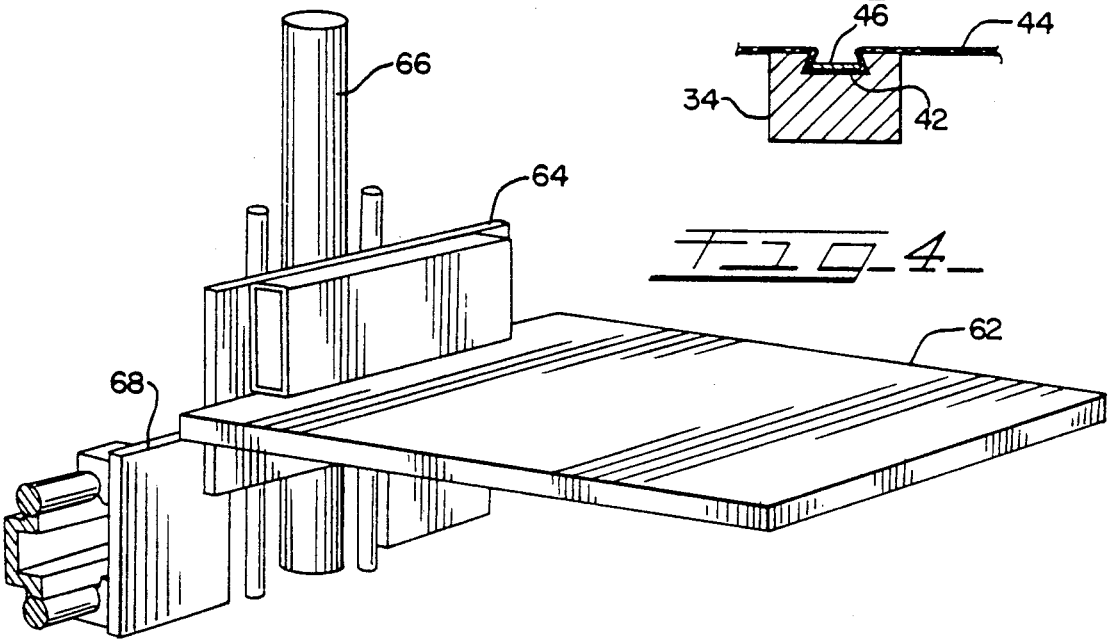

SCREEN TENSIONING AND FRAMING DEVICE AND METHOD THEREFOR

TECHNICAL FIELD OF THE INVENTION

The present invention relates to the tensioning and framing of fabrics, particularly of screens for use in screen printing.

BACKGROUND OF THE INVENTION

In the screen printing industry, advances in the art have resulted in the ability to create higher tensions in screens. While higher screen tensions are certainly beneficial, several problems associated with the higher tensions of modern screens have become apparent.

For example, higher screen tensions exacerbate problems of imbalanced tension in the warp and weft directions. Imbalanced tension typically occurs because the screen material stretches more in the warp direction than in the weft direction, creating distortion and ripples in the screen, especially towards the corners. Distortion accelerates screen mesh fatigue caused during the printing process. Increased screen tension also increases convex displacement of the screen frame which may result in imbalanced tension and fatigue. If tension is applied too rapidly, the stress may result in excessive strain followed by premature fatigue. If too much tension is applied to the screen in either the warp or weft direction, the screen fibers may also tend to neck, resulting in a severely weakened or unusable screen.

In tensioning and framing a screen, the screen is typically stretched over a rectangular frame. The screen mesh is commonly made of polyester or nylon. Stretching the screen over the screen frame can be done by hand, resulting in a number of individual operations to ensure that the screen is properly tensioned. Hand tensioning is time-consuming and sometimes results in poorly tensioned screens due to human error. Alternatively, the screen can be tensioned mechanically. For example, edges of the screen may be attached to rollers, and the rollers turned to create tension in the screen. When the screen is at the proper tension the rollers are then locked into place.

A screen can also be tensioned by continuous or sequential stretcher bars. However, the tensioning performed by these bars suffers from the same problems of imbalanced tensioning, rippling, and weakening of the screen material described above. The stretcher bars of the prior art do not provide for balanced screen tensions nor elimination of problems resulting from imbalanced tension as does the present invention.

A need has developed for a screen tensioning and framing device which provides for a well-balanced screen tension, thus avoiding problems such as screen and image distortion, and minimizing screen mesh fatigue. A need has also developed for a device which compensates for convex screen frame displacement when tensioning a screen, and which eliminates necking of screen fibers due to overtensioning from time and/or stress. A need has further developed for a screen which has a smaller ratio of displacement from the center to the perimeter of the mesh. The screen tensioning and framing device of the present invention solves these and other problems.

SUMMARY OF THE INVENTION

According to the present invention, an improved screen tensioning and framing device has been developed. The screen tensioning and framing device of the present invention comprises two opposing pairs of bars, the opposing bars being generally parallel to each other, means for attaching an edge portion of the screen to each of the bars, and means for pulling each of the bars to create tension in the screen.

The present invention further comprises a main frame, the main frame comprising two pair of opposing frame members, the opposing frame members generally parallel to each other, means for affixing the pulling means to the main frame, means for supporting a screen frame, means for pre-stressing the screen frame, means for heating the screen, means for raising the heating means, means for maintaining the screen at the screen material softening temperature, means for balancing the stress in both the moving the heating means, and means for massaging the screen.

It is an object of the present invention to provide a screen tensioning and framing device which provides for a well-balanced screen tension, thus avoiding problems such as screen and image distortion, and minimizing screen mesh fatigue. It is a further object of the present invention to provide a device which compensates for convex screen frame displacement when tensioning a screen, and which eliminates necking of screen fibers due to overtensioning.

Other advantages and aspects of the invention will become apparent upon making reference to the specification, claims, and drawings to follow.

BRIEF DESCRIPTION OF THE DRAWINGS

FIG. 2 is a perspective view of a stretcher bar and housing holding the pulling and pre-stressing air cylinders.

FIG. 3 is a cross-sectional view of a stretcher bar as it holds an edge of the screen.

FIG. 4 is a perspective view of the heating element and heating element housing.

DETAILED DESCRIPTION OF THE INVENTION

Figure 1:
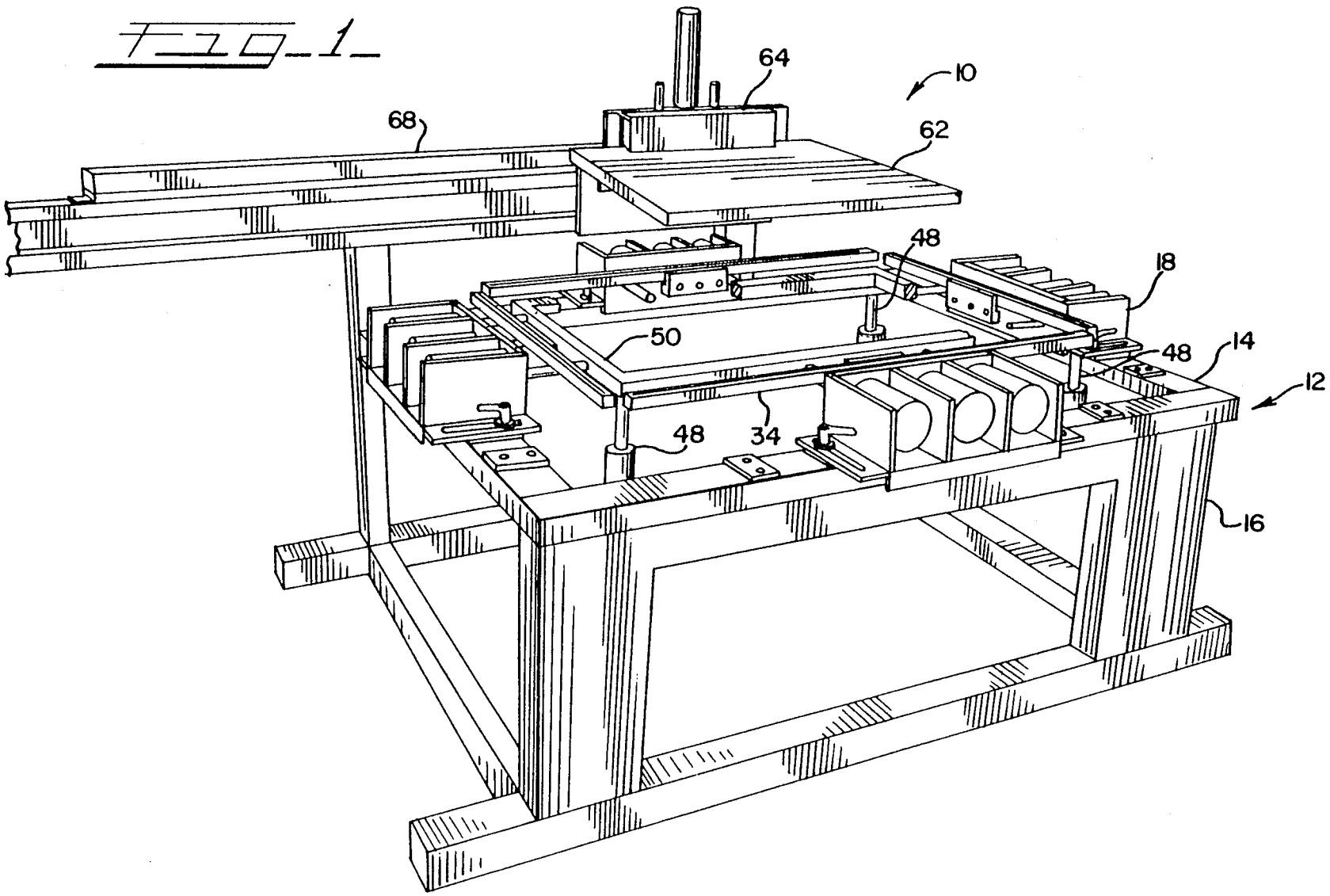
FIG. 1 is a perspective view of the screen tensioning and framing device of the present invention.
Figure 5:
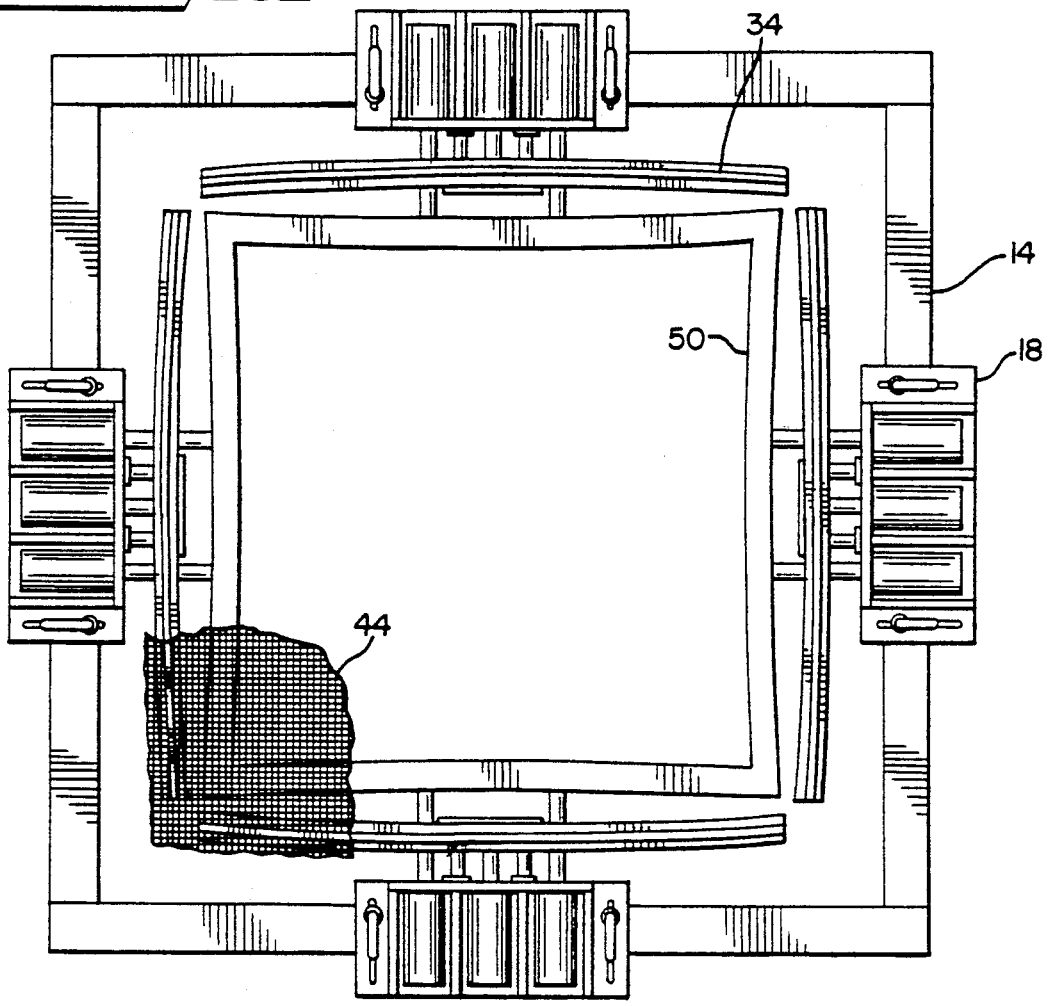
FIG. 5 is a perspective view of the screen frame and stretcher bars during the tensioning process.
Figure 6:
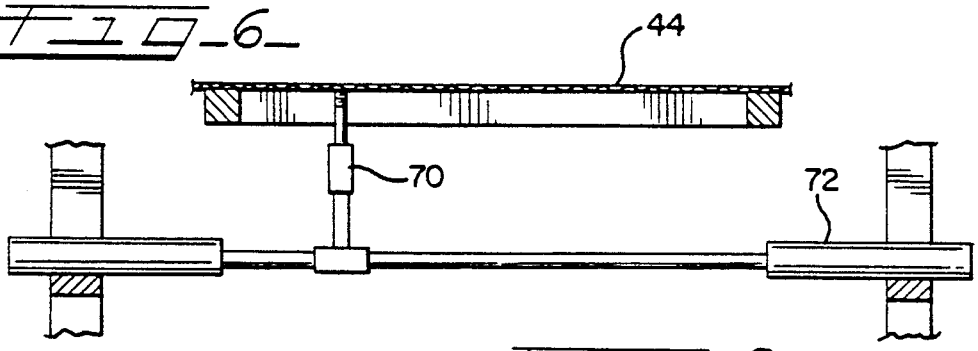
FIG. 6 is a side view of the blade as it massages the underside of the screen.
Figure 7:
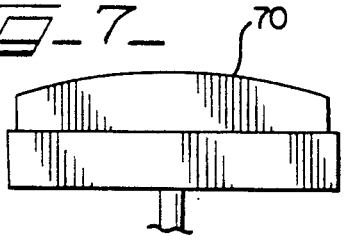
FIG. 7 is a perspective view of the blade.
Figure 8:
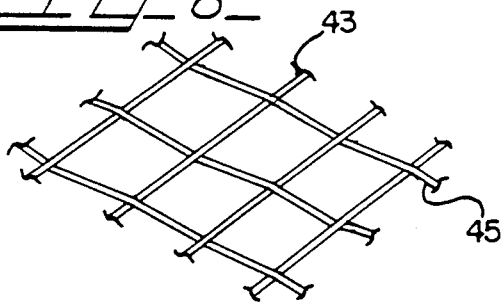
FIG. 8 is a perspective enlarged view of the mesh of a screen.

While this invention is susceptible of embodiment in many different forms, there is shown in the drawings, and will herein be described in detail, a preferred embodiment of the invention, with the understanding that the present disclosure is to be considered as an exemplification of the principles of the invention, and is not intended to limit the broad aspect of the invention to the embodiment illustrated.

Referring now to the drawings, FIG. 1 discloses the screen tensioning and framing device 10 of the present invention. The device 10 comprises a main frame 12. The main frame 12 has two pair of opposing members 14. The opposing main frame members 14 are generally parallel to each other such that they form a rectangle or square. The main frame members 14 are supported by legs 16.

A housing 18 is attached to generally the center of each main frame member 14. The housing 18 is removably and slidably affixable to the main frame members 14. The housing 18 is adapted to slide inward and outward from the main frame members 14 through slots 20. This allows for use of different screen frame and screen sizes. The housing 18 comprises a front wall 22 and end walls 24. The housing 18 also has a pair of interior walls 26 which form three compartments 28. The front wall 22 of the middle compartment 28 is adapted to accept a first air cylinder 30.

The first air cylinder 30 attaches to the inside of the front wall 22 of the middle compartment 28 of the housing 18, and has extending from it a first rod 32. The first rod 32 extends through the front wall 22. A stretcher bar 34 is attached to the first rod 32 by a block 36 integral with the first rod 32. The block 36 is adapted to accept the stretcher bar 34, and to permit the stretcher bar 34 to be affixed thereto. The stretcher bars 34 are made of a semi-rigid material, with quick recovery, high fatigue resistance, and are rectangular in cross-section. Opposing pairs of stretcher bars 34 are generally parallel to each other.

Attached to the outside of the front wall 22 of the housing 18 are a pair of guide bars 38. The block 36 has a corresponding pair of openings 40 to accept the guide bars 38. The guide bars 38 support the block 36 and stretcher bars 34 and also keep the stretcher bars 34 travelling is a straight line.

Each of the stretcher bars 34 has a longitudinal channel 42 in one of its faces, preferably the top face. An edge portion of the screen 44 is placed in the channel 42 and a flexible strip 46 adapted to fit into the channel 42 is placed over the screen 44 and inserted into the channel 42. The screen 44 comprises a fine mesh having weft fibers 43 and warp fibers 45. The flexible strip 46 prevents the edge portion of the screen 44 from pulling out of the channel 42, thereby attaching the screen 44 to the stretcher bars 34. The flexible strip 46 may be made of a polyethylene material.

Air cylinders 48 are disposed in generally the center of the main frame 12 to support the corners of a screen frame 50 such that the screen frame 50 is generally centered between the stretcher bars 34. The air cylinders 48 are adapted to lift the screen frame 50 to meet the screen 44 after the screen 44 has been tensioned. The travel of the air cylinders 48 is approximately 2 inches.

In each of the outer compartments 28 of the housing 18 are second and third air cylinders 52 and 54. The second and third air cylinders 52 and 54 are placed below the plane of the stretcher bars 34. The front wall 22 of the housing 18 is adapted to accept the second and third air cylinders 52 and 54. Second and third rods 56 and 58 extend from the second and third air cylinders 52 and 54 respectively, and through the front wall 22 of the housing 18. Second and third rods 56 and 58 push against the outer edges of the screen frame 50 to prestress the screen frame 50. The second and third rods 56 and 58 have a rounded head 60 attached at their distal ends which contact the screen frame 50.

During the tensioning process, a heating element 62 can be suspended over the center or image area of the screen 44. The heating element 62 comprises a porcelain heating plate. The heating plate is on the order of 20"×25" to 25"×36", but may be of any reasonable size. The heating element 62 is suspended over the screen 44 by a heating element housing 64. The heating element housing 64 is adapted to be raised and lowered by a drive cylinder 66 adapted to raise and lower the heating element 62 in the vertical direction. The heating element housing 64 is also laterally movable along a track 68. The lateral movement of the heating element housing 64 permits the housing 64 to be removed from above the screen frame 50 and screen 44 such that a finished screen frame 50 can be removed from the frame support 48 and another placed on the frame support 48 to repeat the screen stretching process.

Also during the tensioning process, a blade 70 oscillates while in contact with the underside of the screen 44, thereby massaging the squeegee side of the screen 44. The blade 70 may be made of a medium density polyurethane. The blade 70 may be contoured to reflect the displacement curve of the screen 44. A pair of opposing air cylinders 72 work to oscillate the blade 70 to massage the screen.

A typical screen stretching operation commences as follows. An empty screen frame 50 is placed on the screen frame support air cylinders 48. The screen mesh 44 is placed over the stretcher bars 34. The screen frame 44 rests slightly below the stretcher bars 34. Edge portions of the screen 44 are attached to the stretcher bars 34 in the manner described above. The first air cylinder 30 is activated to pull slightly on the screen 44. In so doing, the center of the screen 44 is displaced slightly more than the edges of the screen 44. This bows the stretcher bars 34. Strain gauges can be placed on the stretcher bars 34 to determine the tension in the both the warp and weft directions of the screen 44. Displacement transducers can be placed on the stretcher bars 34 to determine displacement of the bars 34.

The second and third air cylinders 52 and 54 simultaneously press against the outer surfaces of the screen frame 50, thereby pre-stressing the screen frame 50. This compressive force is independent of the tension force on the mesh 44. The second and third air cylinders 52 and 54 maintain pressure on the screen frame 44 subsequent to the oscillating tension, near the completion of the screen stretching process. Load cells and transducers can be employed to cooperate with the air cylinders to monitor the load being applied to the screen frame 50, and the load applied to the mesh. The pre-stressing of the screen frame 50 minimizes convex displacement of the screen frame 50 subsequent to the tensioning and during the print stroke. The screen frame 50 and screen 44 must be treated independently for them to overcome the fatiguing effects of the squeegee and flood bar on them.

While the screen 44 is being tensioned, the first air cylinder 30 pulsates in the direction of pull. The pulsations are variable at about 10 or more cycles per second. This results in a cycle in the screen of tension-relax-tension. Opposing first air cylinders 30 are controlled using a microprocessor 74 programed to accomplish this pulsating motion. The first air cylinders 30 of opposing stretcher bars 34 are activated by a single control. The microprocessor can also monitor the load applied in the warp and weft directions from feedback through the strain gauges on the stretcher bars 34. This way, the load applied by the first air cylinders 30 in the warp and weft directions can be balanced. The pulsations combined with the action of the stretcher bars result in a more even tension applied throughout the screen stretching process. It also results in alignment of the molecular chains in the screen material to align along the axis of stretch, thereby stabilizing the screen mesh fibers and giving them added tensile strength. When used in conjunction with the bow configuration, this results in a higher tension in the middle of the screen 44 and relieves overtensioning of the corners of the mesh.

While the screen 44 is being tensioned, the blade 70 oscillates while contacting the screen 44, thereby massaging the squeegee side of the screen 44. The blade 70 travels at approximately 40 inches per second. The blade 70 descends as it reaches the end of the stroke across the screen. This way, it avoids the edges of the screen 44 and applies additional energy to the central area of the mesh. The blade 70 may initially oscillate over the entire screen 44. The strokes of the blade 70 may shorten as the tensioning process continues. The stroke may be either unidirectional or bidirectional. This insures that the central area of the mesh is massaged the most, thus improving stability and maintaining elasticity near the perimeter.

The heating element 62 is placed over the screen 44 prior to and/or during the stretching process. It has been found that the polyester material of which screens are typically made has its softening transformation temperature of approximately 70° C. or 158° F. Heating the screen 44 allows for more rapid alignment of the mesh filament molecular chains in the direction of tension. Alignment of the molecules of the screen 44 result in a screen which will have higher tensile strength, and therefore can be subjected to higher tensions and allow the screen material to be stretched further with less likelihood of necking or plastic deformation. The heating of the screen 44 also shortens the time necessary for stabilizing the mesh through the tension-relax-tension process, and further stabilizes the mesh.

The heating element 62 can be maintained at a distance from the screen 44 to maintain the screen 44 at the critical temperature. This may be accomplished by any means, but preferably comprises a temperature sensor (not shown) disposed beneath and near the center of the screen 44. The temperature sensor is designed to keep the temperature of the mesh within two degrees of the critical 158° F. temperature. The sensor sends a temperature feedback signal to the fourth air cylinder 66 through a microprocessor 74. The microprocessor 74 is programmed to modulate the height of the heating element 62 from the screen 44 to maintain the desired temperature.

Once the screen 44 is properly tensioned using the above process, the screen frame support air cylinders 48 are activated. The air cylinders 48 raise the screen frame 50 to lightly touch the screen 44. The screen 44 is then adhered to the screen frame 50. The screen frame 50 can be made of any suitable material. The outside surface of the screen frame 50 is preferable flat, but may be made of any suitable profile. The upper surface, to which the screen 44 is adhered, is also preferably flat. The screen contact surface of the screen frame may be inclined at an angle of approximately 2 degrees toward the inner edge to facilitate screen contact with the screen frame 50. The screen 44 is adhered to the screen frame 50 using any suitable adhesive, preferably a quick drying one.

After the adhesive has dried, the excess mesh is cut from the edges of the screen. The heating element 62 is moved along the track out of the way, and the screen frame and screen mesh is then removed from the device, and a new screen inserted to repeat the process.

While the specific embodiments have been illustrated and described, numerous modifications come to mind without departing from the spirit of the invention, and the scope of protection is limited only by the scope of the accompanying claims.

I claim:

1. A device for tensioning and framing a screen having two pairs of opposing edge portions comprising:

a main frame assembly;

two opposing pairs of bars, each of said bars having an outer face, said opposing bars being generally parallel to each other;

means for attaching an edge portion of the screen to each of said bars;

means for pulling each of said bars to create tension in the screen; and, means for heating the screen, said heating means comprising a heating plate.

2. The screen tensioning and framing device of claim 1 wherein said attaching means comprises a longitudinal channel in each of said bars, and a flexible strip insertable into said channel.

3. The screen tensioning and framing device of claim 1 wherein said pulling means comprises a first air cylinder corresponding to each of said bars, said first air cylinder adapted to pull each of said bars in a direction outwardly from its opposing bar.

4. The screen tensioning and framing device of claims 1 or 3 further comprising means for pulsating said pulling means while pulling said bars.

5. The screen tensioning and framing device of claim 4 wherein said pulsating means pulsates at variable frequencies from multi-second to fraction of a second intervals.

6. The screen tensioning and framing device of claim 1 further comprising a main frame, said main frame comprising two pair of opposing frame members, said opposing frame members generally parallel to each other; and, means for affixing said pulling means to said main frame.

7. The screen tensioning and framing device of claim 1 further comprising a screen frame.

8. The screen tensioning and framing device of claim 6 wherein said affixing means comprises a housing attached to said main frame and adapted to accept said pulling means.

9. The screen tensioning and framing device of claim 7 further comprising means for supporting said screen frame.

10. The screen tensioning and framing device of claim 9 wherein said screen frame supporting means comprises air cylinders disposed in generally the center of said main frame assembly, and adapted to raise said screen frame.

11. The screen tensioning and framing device of claim 7 further comprising means for pre-stressing said screen frame.

12. The screen tensioning and framing device of claim 11 wherein said pre-stressing means comprises:

at least one air cylinder adapted to push inwardly against each of the outer faces of said screen frame.

13. The screen tensioning and framing device of claim 1 wherein said heating plate is suspended over generally the usable area of the screen.

14. The screen tensioning and framing device of claim 1 further comprising means for raising said heating means.

15. The screen tensioning and framing device of claim 14 wherein said raising means comprises a drive cylinder adapted to raise said heating means.

16. The screen tensioning and framing device of claim 1 further comprising means for maintaining the screen at a predetermined temperature at which the screen material appreciably softens.

17. The screen tensioning and framing device of claim 16, further comprising means for raising said heating means and wherein said temperature maintenance means further comprises;

a temperature sensor disposed near the center of the screen; and a microprocessor interactive with said temperature sensor and said raising means, and programmed to raise or lower said heating means should the temperature sensor sense a temperature in excess of or below said predetermined temperature.

18. The screen tensioning and framing device of claims 16 or 17 wherein said, predetermined temperature is approximately 158° F.

19. The screen tensioning and framing device of claim 1 further comprising means for massaging the screen.

20. The screen tensioning and framing device of claim 19 wherein said massaging means comprises a blade; and, means for oscillating said blade while said blade remains in contact with the screen.

21. The screen tensioning and framing device of claim 20 wherein said oscillating means comprises drive cylinders adapted to oscillate said blade while said blade remains in contact with the screen.

22. The screen tensioning and framing device of claim 20 wherein said blade travels at a speed of approximately 40 inches per second.

23. The screen tensioning and framing device of claim 1 further comprising means for balancing the tension in the warp and weft fibers of the screen.

24. The screen tensioning and framing device of claim 1 further comprising means for laterally moving said heating means.

25. The screen tensioning and framing device of claim 24 wherein said lateral moving means comprises a horizontal track upon which said heating means is adapted to move.

26. A device for tensioning and framing a screen having two pairs of opposing edge portions comprising:

two opposing pairs of bars, said opposing bars being generally parallel to each other;

means for attaching an edge portion of the screen to each of said bars;

means for pulling each of said bars to create tension in the screen, wherein said pulling means pulsates while pulling said bars;

a main frame, said main frame comprising two pair of opposing frame members, said opposing frame members generally parallel to each other;

means for affixing said pulling means to said main frame;

means for supporting a screen frame;

means for pre-stressing the screen frame;

means for heating the screen;

means for raising said heating means;

means for maintaining the screen at a temperature of approximately 158° F.;

means for massaging the screen;

means for balancing the tension in the warp and weft fibers of the screen; and, 'means for laterally moving said heating means.

27. A method of tensioning and framing a screen comprising the steps of:

pulsatingly tensioning the screen;

heating the center portion of the screen while tensioning the screen to the screen material softening temperature;

maintaining the temperature of the screen at the screen material softening temperature;

pre-stressing the screen frame;

massaging the screen as it is being tensioned; and, adhering the screen to the screen frame after it is tensioned.

28. The method of tensioning and framing a screen of claim 27 further comprising balancing the tension in the warp and weft fibers of the screen.

* * * * *

UNITED STATES PATENT AND TRADEMARK OFFICE

CERTIFICATE OF CORRECTION

PATENT NO. : 5,063,842

DATED : November 12, 1991

INVENTOR(S) : Joseph Clarke

It is certified that error appears in the above-identified patent and that said Letters Patent is hereby corrected as shown below:

Column 1, line 67, delete "20".
Column 2, line 16, after "both" delete "the".
Column 3, line 29, delete "is" and insert --in--.
Column 4, line 29, after "tension in" delete "the".
Column 4, line 55, delete "programed" and insert --programmed--.
Column 6, line 33, after "comprising" insert --:--.
Column 7, Claim 17, line 8, delete ";" and insert --:--.
Column 7, Claim 18, line 18, delete ",".
Column 7, Claim 20, line 23, after "comprises" insert --:--.
Column 8, Claim 26, line 25, before "means" delete "'".

Signed and Sealed this

Thirteenth Day of April, 1993

*Attest:*

STEPHEN G. KUNIN

*Attesting Officer*

*Acting Commissioner of Patents and Trademarks*